US009381416B2

(12) United States Patent
Stojanovic

(10) Patent No.: US 9,381,416 B2
(45) Date of Patent: Jul. 5, 2016

(54) BATTING AID

(71) Applicant: Deyan Stojanovic, St. Augustine, FL (US)

(72) Inventor: Deyan Stojanovic, St. Augustine, FL (US)

( * ) Notice: Subject to any disclaimer, the term of this patent is extended or adjusted under 35 U.S.C. 154(b) by 0 days.

(21) Appl. No.: 14/308,475

(22) Filed: Jun. 18, 2014

(65) Prior Publication Data

US 2015/0005109 A1 Jan. 1, 2015

Related U.S. Application Data

(60) Provisional application No. 61/839,553, filed on Jun. 26, 2013.

(51) Int. Cl.
*A63B 69/00* (2006.01)

(52) U.S. Cl.
CPC ..... *A63B 69/0075* (2013.01); *A63B 69/0002* (2013.01); *A63B 2069/0008* (2013.01); *A63B 2225/09* (2013.01)

(58) Field of Classification Search
CPC ..... A63B 69/0002; A63B 69/0057; A63B 69/0075; A63B 69/0091; A63B 69/0071
USPC ..... 473/417, 453, 422, 451, 452, 418
See application file for complete search history.

(56) References Cited

U.S. PATENT DOCUMENTS

| | | | | |
|---|---|---|---|---|
| 3,940,131 | A * | 2/1976 | St. Claire, Jr. | 473/417 |
| 4,516,771 | A * | 5/1985 | Nau | 473/453 |
| 5,435,545 | A * | 7/1995 | Marotta | 473/417 |
| 5,478,070 | A * | 12/1995 | Morrison | 473/419 |
| 5,485,993 | A * | 1/1996 | Lipsett | 473/448 |
| 5,928,092 | A * | 7/1999 | Keeter et al. | 473/417 |
| 5,951,413 | A * | 9/1999 | Guerriero | 473/417 |
| 6,413,175 | B1 * | 7/2002 | Mooney, Jr. | 473/417 |
| 6,878,077 | B2 * | 4/2005 | Andrews | 473/453 |
| 7,517,290 | B1 * | 4/2009 | Springer | 473/422 |
| 7,601,081 | B1 * | 10/2009 | Larkey | 473/454 |
| 7,662,052 | B1 | 2/2010 | Vidrine | |
| 8,075,424 | B1 * | 12/2011 | Hostetler | 473/447 |
| 8,262,515 | B2 * | 9/2012 | Morris | 473/420 |
| 8,556,753 | B1 * | 10/2013 | Dixon, Jr. | 473/417 |
| 8,602,920 | B2 * | 12/2013 | Windsor | 473/453 |
| 8,992,348 | B2 * | 3/2015 | Meier et al. | 473/417 |
| 2005/0266936 | A1 * | 12/2005 | Gutierrez | 473/417 |
| 2008/0085787 | A1 * | 4/2008 | Molloy et al. | 473/417 |
| 2011/0077109 | A1 * | 3/2011 | Crowley | 473/453 |

OTHER PUBLICATIONS

Sam's Club, screen shot from website, http://wwwsamsclub.com/sams/louisville-slugger-instructo-swing-1500/prod120083.ip, Jun. 12, 2014, 2 pages.

* cited by examiner

*Primary Examiner* — Mitra Aryanpour

(57) ABSTRACT

A batting aid has an upstanding tee with an upper end and a lower end. A connector adapted to attach to the upper end of the tee has a first connection means and a second connection means. The second connection means is positioned at an angle from the first connection means. A first guide is attached to the first connection means and positioned at an angle with the tee. A second guide is attached to the second connection means and positioned at an angle with the tee. A batter moves a bat towards a ball on the tee in a direction along the first guide, strikes the ball with the bat, and moves the bat along the second guide after striking the ball.

20 Claims, 7 Drawing Sheets

BATTING AID

CROSS-REFERENCE TO RELATED APPLICATIONS

This application claims the benefit of U.S. Provisional Application No. 61/839,553, filed Jun. 26, 2013, the entire contents of which is hereby incorporated by reference.

BACKGROUND OF THE INVENTION

1. Field of the Invention

The present invention is directed to an aid for teaching a proper baseball swing. In particular, the invention is directed to a structure that helps a user correctly direct a swing of a bat.

2. Description of Related Art

A proper baseball (or softball or T-ball) swing is achieved by a downward motion of the bat until the point of contact (POC) with the ball. After the POC, the motion of the bat should then become either parallel to the ground or slightly upward in trajectory. This is not a natural motion for most people learning how to swing a baseball bat. As such, it takes hours upon hours of repetitive practice to build muscle memory so that this motion becomes natural to the batter.

Presently, some structures exist for practicing a baseball swing. The most common structure is a tee, such as that illustrated in FIG. 1. A tee 10 comprises an upstanding shaft 12 attached to a base 14. The tee 12 has a hollow 16 for receiving a ball. The shaft 12 is at a height commensurate with a baseball strike zone. The tee 10 allows a batter to practice hitting a ball repetitively. However, the tee does not teach proper swing motion to the batter. Nothing is present to stop a bat from swinging upwards from the beginning of the swing motion all the way to the end of the swing motion. Likewise, nothing is present to stop a bat from swinging downwards after the POC. If a person develops a bad swing form using the tee, it will be difficult to learn a proper swing form. He will have formed improper muscle memory that will need correcting.

Attempts to teach a proper swing have included the "instructo swing" which includes a U-shaped bar that is positioned above the ground. The bar is positioned such that the opening of the "U" is pointed at a batter. The "U" is positioned in a plane perpendicular to the ground. The arms can be parallel to the ground or slightly angled so the opening is facing either upwards or downwards, allowing the batter to practice hitting a ball at different heights. If the batter hits the structure during a swing, he will know that his swing is off. This structure does not prevent a batter from using bad form. The batter can hit the ball from a variety of upward or downward angles. His motion is not guided in any manner.

Other structures similar to the U-shaped bar are smaller, typically only a few lengths of a baseball long. (See U.S. Pat. No. 7,662,052.) They are positioned in a similar fashion to the larger U-shaped structure described above. These are positioned at an end of a bar, where an upstanding shaft attaches to the bar near the middle of the bar. These smaller "U" shaped structures may teach a batter to hit a ball at the center location on the bat. If the batter swings too far outward, he will hit the structure. This tells him that his swing is too far. This structure does not teach proper swing motion. A batter using the structure can hit the ball from any angle. His swing motion is not guided.

No structure currently exists that teaches a batter mechanics of a proper full swing. A need exists for a batting aid that helps a batter learn the mechanics of a proper full baseball swing. The present invention fulfills this need.

SUMMARY OF THE INVENTION

The batting aid of the present invention includes an upstanding tee having an upper end and a lower end, the lower end being at ground level. The batting aid includes a connector adapted to attach to the upper end of the tee, the connector having a first and a second connection. The second connection is rotated at an angle from the first connection. The batting aid has a first guide with a distal end and a proximal end attached to the first connection. The first guide is positioned at an angle with the tee so that it guides the pre-point of contact (POC) swing in a proper direction. The batting aid includes a second guide having a distal end and a proximal end attached to the second connection. The second guide is positioned at an angle with the tee so that it guides the post-POC swing in a proper direction. The batting aid causes a batter to move his bat towards a ball on the tee in a direction along the first guide, emulating a proper pre-POC swing. After striking the ball, the batter is free to move his bat along the second guide, emulating a proper post-POC swing.

BRIEF DESCRIPTION OF THE DRAWINGS

The exact nature of this invention, as well as the objects and advantages thereof, will become readily apparent upon consideration of the following specification in conjunction with the accompanying drawings in which like reference numerals designate like parts throughout the figures thereof and wherein.

DETAILED DESCRIPTION OF THE PREFERRED EMBODIMENTS

Exemplary embodiments of a batting aid will now be described in detail. These embodiments describe various features and functionality of the batting aid.

Figure 1:
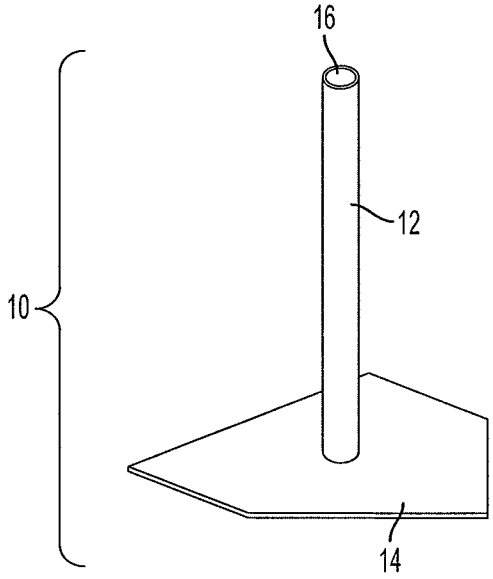
FIG. 1 PRIOR ART
FIG. 1 is a perspective illustration of a prior art baseball tee.
Figure 2:
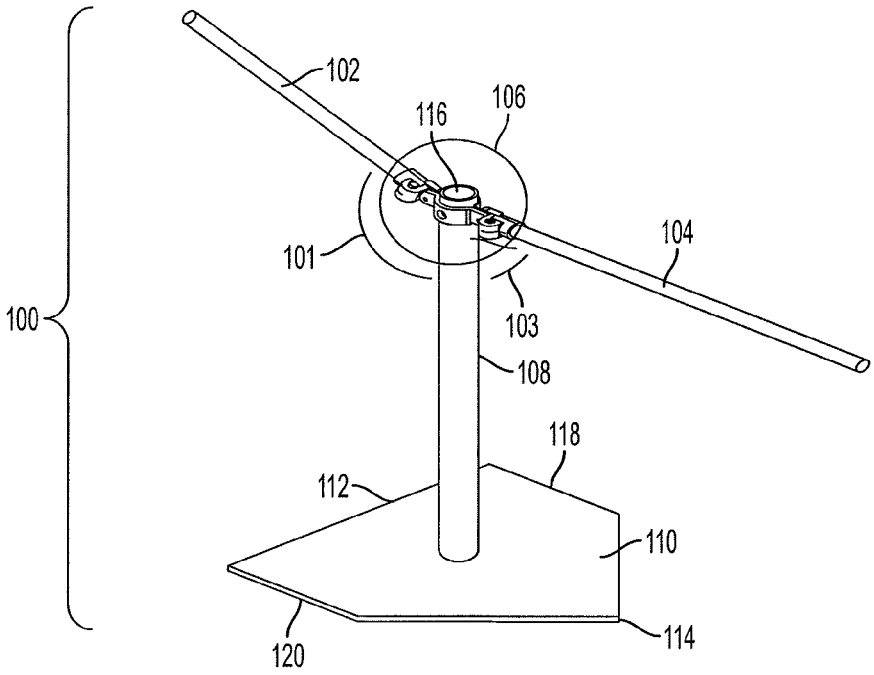
FIG. 2 is a perspective illustration representing a batting aid, according to an embodiment of the invention.

FIG. 2 illustrates the batting aid 100 from an angle between the front side 114 of the batting aid 100 and a left side 120 of the batting aid 100. The batting aid 100 can include a structured rear guide 102 (rear guide 102), a structured front guide 104 (front guide 104) and a connector 106. In the embodiment illustrated in FIG. 2, the batting aid 100 can include the upstanding shaft 108 and the support base 110. The upstanding shaft 108 and the support base 110 may instead be previously provided, such that the batting aid 100 can exclude the upstanding shaft 108 and the support base. In this embodiment, the batting aid includes only the front guide 104, the rear guide 102 and the connector 106.

The support base 110 may be any shape or design sufficient to provide support to the batting aid 100. The support base 110 is positioned on the ground and is attached to a bottom of the upstanding shaft 108 so the upstanding shaft 108 is substantially perpendicular to the ground. In FIG. 2, the connector 106 attaches to the upstanding shaft 108, and the rear guide 102 and the front guide 104 attach to the connector 106. The rear guide 102 and the front guide 104 are positioned on a plane which is perpendicular to the ground and extends from a center of a rear side 112 of the batting aid 100 to a center of a front side 114 of the batting aid 100.

An angle 101 exists between the rear guide 102 and the upstanding shaft 108. The angle 101 may be between approximately 110 degrees and approximately 135 degrees. This forces a downwards swing motion pre-POC if the batter is to not hit the rear guide 102. Angle 101 may also be between approximately 45 degrees and approximately 70 degrees if a batter prefers to learn a rising swing pre-POC.

Angle 103 exists between the front guide 104 and the upstanding shaft 108. Angle 103 may be between approximately 90 degrees and approximately 115 degrees, forcing an upwards swing motion post-POC. Angle 103 may also be any other value. For example, the angle 103 may be below 90 degrees if a batter prefers to learn a downwards swing post-POC.

The connector 106 may be designed so that the angles 101 and 103 are adjustable. For example, the rear guide 102 may be adjustable so that the angle 101 can be set to a value between 110 degrees and 135 degrees and the front guide 104 may be adjustable so that angle 103 can be set to a value between 90 degrees and 115 degrees. This feature may also be implemented such that the connector 106 and the rear guide 102 and the front guide 104 attach directly to the upstanding shaft 108 without use of the connector 106.

In the embodiment of FIG. 2, the rear guide 102 and the front guide 104 are approximately 24 inches in length. The rear guide 102 and the front guide 104 may also be shorter or longer than 24 inches to accommodate for a smaller or larger batter. For example, the rear guide 102 and the front guide 104 may be telescoping so that they can be set to any length within a range, for example, between 15 inches and 30 inches.

The guides 102 and 104 may be made of any combination of metal, plastic, rubber, highly rigid foam, durable foam or any other material. The rear guide 102 and the front guide 104 may be detachable from the connector 106 (if the batting aid 100 does not include the connector 106, then detachable from the upstanding shaft 108). For example, detachable guides 102, 104 may be preferable when the rear guide 102 and the front guide 104 are made with a harder material, such as metal, rigid foam or plastic.

The guides 102, 104 each include at least one rod having two end portions and an elongated portion perpendicular to and between the two end portions. At least one end portion may have a circular shape, a square shape, a rectangular shape, a triangular shape, a hexagonal shape, a heptagonal shape or the like. The elongated portion of the guides 102, 104 may taper between the two end portions or may maintain a constant thickness. When the elongated portion tapers, one of the end portions may be nothing more than a point, or may be larger than a point.

This detachability provides advantages. A detachable rear guide 102 and front guide 104 allow easy movement and storage of the batting aid 100. Also, a detachable rear guide 102 and front guide 104 provide durability. A batter will swing a bat in the vicinity of the rear guide 102 and the front guide 104. When a batter hits a rear guide 102 or a front guide 104 which is detachable, then the hit rear guide 102 or front guide 104 will simply detach from the batting aid 100 and fall to the ground undamaged. Detachment also protects the batter, property or others in the vicinity of the batting aid 100. If a batter hits and breaks off a piece of a rear guide 102 or a front guide 104 which is not detachable, the broken piece may propel towards the batter, property or others and cause injury or damage.

The rear guide 102 and the front guide 104 may also not be detachable from the connector 106 (or the upstanding shaft 108). If this is the case, flexible material such as rubber or durable foam may be used. Using these materials, detachability is not as important because of the flexibility of the material. When a batter hits a rear guide 102 or a front guide 104 made of a flexible material, it is unlikely that the rear guide 102 or the front guide 104 will become damaged or will harm a person or property due to the flexible nature of these materials.

The upstanding shaft 108 includes an opening 116 at a top end of the tee opposite a bottom end that is attached to the support base 110. A ball (not shown) is positioned so that it rests on the opening 116. The ball may be any kind of ball which is swung at by a bat, including a baseball or a softball.

An overview of use of the batting aid 100 will now be described. Another example will be illustrated and explained with reference to FIGS. 14 and 15. In this example, we will assume that the angle 101 is between 110 degrees and 135 degrees and the angle 103 is 90 degrees. A batter may stand on either a right side 118 or the left side 120 of the batting aid 100. If the batter is right handed, the batter will most likely stand on the right side 118 of the batting aid 100. If the batter is left handed, the batter will most likely stand on the left side 118 of the batting aid 100. The batter holds a bat at a position towards the rear side 112 of the batting aid 100. The batter then begins to swing the bat towards the ball which is positioned on the hollow 116.

As the batter is swinging the bat towards the ball, he is to not hit the rear guide 102. This forces the batter to swing the bat towards the ball with a downward arc. This downward trajectory is desired at the POC because it will help create backspin at contact by creating lift on the ball as it travels forward. The batter is to not hit the front guide 104 as well after making contact with the ball. This forces the batter to change the arc of the bat path to a flat or upward angle at and after the POC. This upwards trajectory at and after the POC is desired because it creates a longer swing path in the strike zone (the bat does not drop below the strike zone) allowing for a greater likelihood of contact with a moving ball in a game environment.

Figure 3:
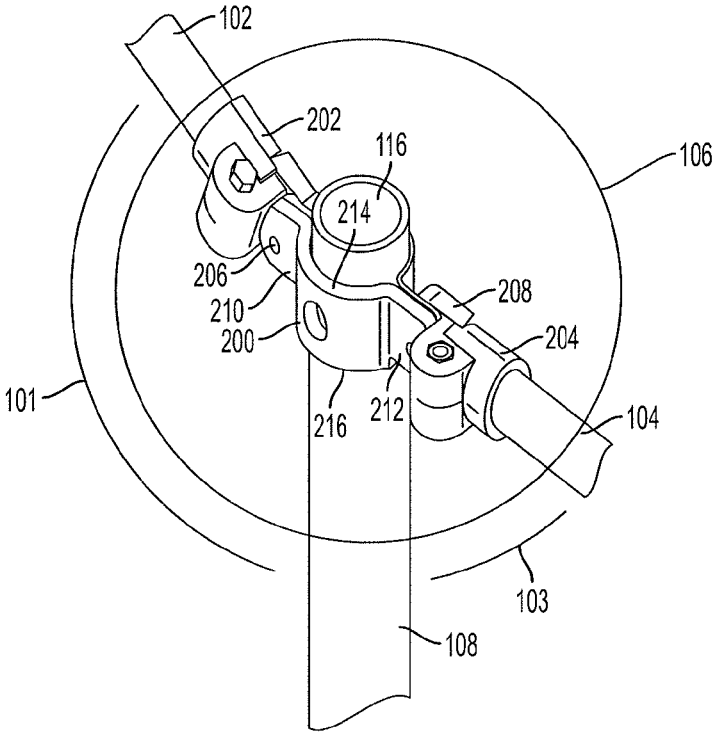
FIG. 3 is an exploded view illustrating one embodiment of a connector used in an embodiment of the present invention.

FIG. 3 shows a connector 106 having a ring 200, a rear bracket 202 and a front bracket 204. The connector 106 may include other structure that can attach to a rod. The connector 106 may also include a rear joint 206 between the ring 200 and the rear bracket 202 and/or a front joint 208 between the ring 200 and the front bracket 202. The connector 106 has a top end 214 located towards an upper end of the upstanding shaft 108 and a bottom end 216 located towards a lower end of the upstanding shaft 108.

In the embodiment illustrated in FIG. 3, the ring 200 is placed over the upstanding shaft 108. The ring is positioned so that a rear wing 210 and a front wing 212 of the ring 200 are positioned on a plane extending from the center of the rear end 112 of the base 110 to the center of the front end 114 of the base 110. The ring 200 is designed so that it can fit onto any size upstanding shaft 108. The ring 200 may simply slide onto the upstanding shaft 108.

The ring 200 can be fastened to the upstanding shaft 108 after being positioned around the upstanding shaft 108. This feature (whereby the ring 200 slides onto the upstanding shaft 108 or whereby the ring 200 is fastened to the upstanding shaft 108) allows for portability of the batting aid 100 between tees 108, physical portability between locations and ease of storage (as the ring 200 can be removed from the upstanding shaft 108 to reduce the size of the structure). In this embodiment, the ring 210 is positioned near the hollow 116 at the upper end of the upstanding shaft 108. The ring 110 may instead be positioned elsewhere on the upstanding shaft 108 and other equipment (not illustrated) may be used to cause the guides 102, 104 to be in a position in which they can still aid in learning a proper swing motion.

The rear wing 210 is connected the rear bracket 202. In some embodiments, the rear joint 206 is formed at this connection. The rear guide 102 is connected to the rear bracket 202. As previously discussed, this connection between the rear guide 102 and the rear bracket 202 may be detachable for safety and durability reasons. The rear bracket 202 may be connected to the rear wing 210 at an angle. This angle allows the rear guide 102 to be at an angle 101 from the upstanding shaft 108. The rear joint 206 may be designed such that the angle between the rear bracket 202 and the rear wing 210 is adjustable. This allows the batter to adjust the angle 101 to satisfy his practice needs. This is advantageous as it allows the batting aid 100 to be configurable to different swing preferences and for different batters.

The front wing 212 is connected the front bracket 204. The front joint 208 may be formed at this connection. The front guide 104 is connected to the front bracket 204. As previously discussed, this connection between the front guide 104 and the front bracket 204 may be detachable for safety and durability reasons. The front bracket 204 may be connected to the front wing 212 at an angle. This angle allows the front guide 104 to be at an angle 103 from the upstanding shaft 108. The front joint 208 may be designed such that the angle between the front bracket 204 and the front wing 212 is adjustable. This allows the batter to adjust the angle 103 to satisfy his practice needs. This is advantageous as it allows the batting aid 100 to be configurable for different swing preferences and for different batters.

Figure 4:
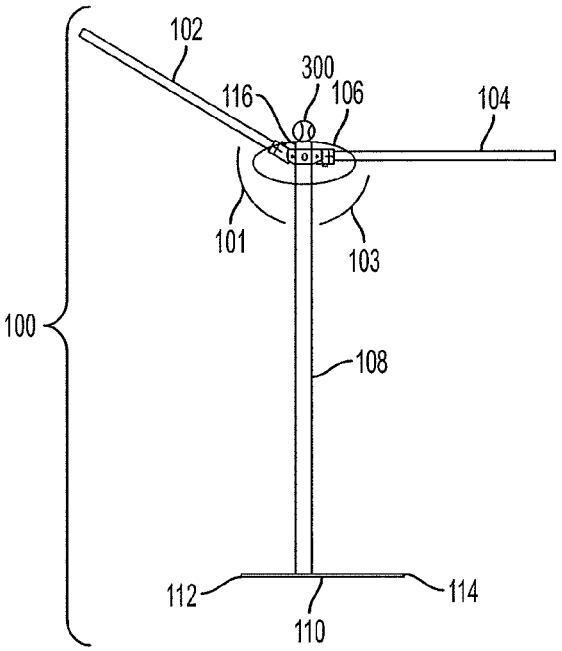
FIG. 4 is a side view of a batting aid, according to an embodiment of the present invention.

FIG. 4 shows the rear guide 102 and the front guide 104 connected by the connector 106 to the upstanding shaft 108. In the embodiment of FIG. 4, we will assume that the angle 101 is 120 degrees and the angle 103 is 90 degrees. As illustrated, a ball 300 is positioned on the hollow 116 at the top end of the upstanding shaft 108. FIG. 4 helps illustrate how the batting aid 100 can help the batter learn the different motions of the swing pre-POC and post-POC.

The batter is to stand facing the batting aid 100 on either the right side 118 if he is swinging right handed or the left side 120 if he is swinging left handed. The batter's bat is to be positioned above and behind the rear guide 102 before the swing. If the bat is positioned too low, then when swinging at the ball 300, it will hit the rear guide 102 indicating an incorrect swing motion. The bat should move downwards towards the ball 300, hit the ball 300, and then continue from the hollow 116 along the front guide 104 at an angle parallel to the ground or in an upwards direction.

When the batter begins to swing, the bat must swing downwards towards the ball 300 or else he will hit the rear guide 102 because the angle 101 is 120 degrees. The batter should try to hit the ball 300 without hitting the rear guide 102 by swinging with a proper motion. If the swing is too far downwards, then he may hit the rear guide 102. If the swing is not downwards enough, then he may not hit the ball 300.

If the batter misses the ball 300 and/or hits the rear guide 102 then his pre-POC swing is not proper and he should try again. If the batter hits the ball and does not hit the rear guide, then his pre-POC swing is proper.

If the batter has properly swung the bat pre-POC, he must then try to properly swing the bat post-POC. Because the angle 103 is 90 degrees, the swing must either become parallel to the ground (or the front guide 104) or should be upwards in order to not hit the front guide 104. If the batter continues to swing downwards, then his bat will hit the front guide 104, indicating that his post-POC swing is not proper and he should try again. If the batter does not hit the front guide 104 with the bat after hitting the ball 300, then his post-POC swing is proper.

The swing should continue from the pre-POC swing to the post-POC swing in a fluid motion (i.e., the moment of transition from pre-POC motion should not be apparent except for the striking of the ball 300). Swinging a bat is like any other motion which requires practice in order to perfect (such as free-throw shooting). In order to learn a proper swing and be able to apply it to a game situation, the batter should practice the proper swing motion repeatedly using the batting aid 100 in order to build muscle memory of the movement.

Figure 5:
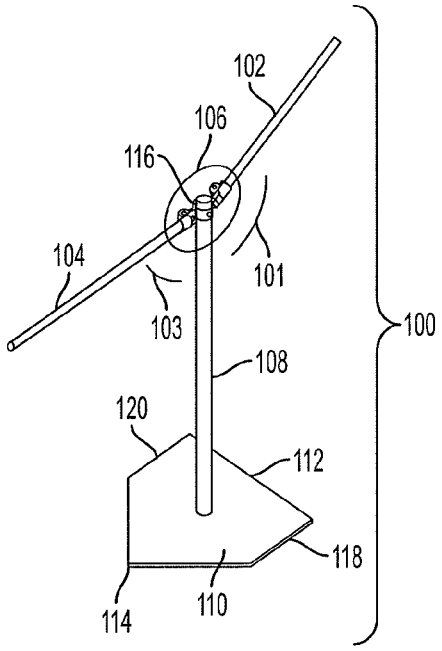
FIG. 5 is a perspective view of a batting aid, according to an embodiment of the present invention.

FIG. 5 illustrates a view from an angle between the front side 114 of the batting aid 100 and the right side 118 of the batting aid 100.

Figure 6:
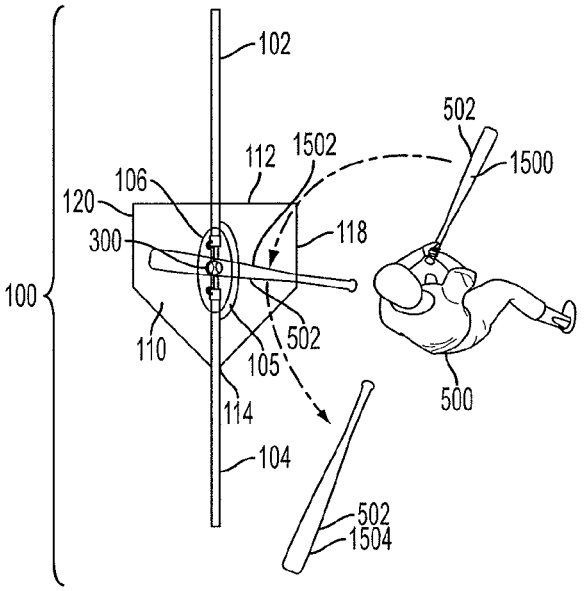
FIG. 6 is a bird's eye view illustrating a batting aid, according to an embodiment of the present invention.

In FIG. 6, the rear guide 102 and the front guide 104 are positioned on a plane extending from the middle of the rear side 112 of the batting aid 100 to the middle of the front side 114 of the batting aid 100. This creates an angle 105 between the rear guide 102 and the front guide 104 which is 180 degrees.

A batter 500 holding a bat 502 is positioned on the right side 118 of the batting aid 100. In FIG. 6, the batter 500 is swinging right handed. Before swinging, the batter 500 holds the bat 502 in a position 1500. When the batter 500 begins to swing, the bat 502 begins moving in a pre-POC motion towards position 1502 where the ball 300 is struck. After striking the ball 300, the bat moves in a post-POC motion towards position 1504, around which the swing may end. As illustrated, the bat 502 proceeds to move in an arc-like shape from position 1500 through position 1502.

Figure 7:
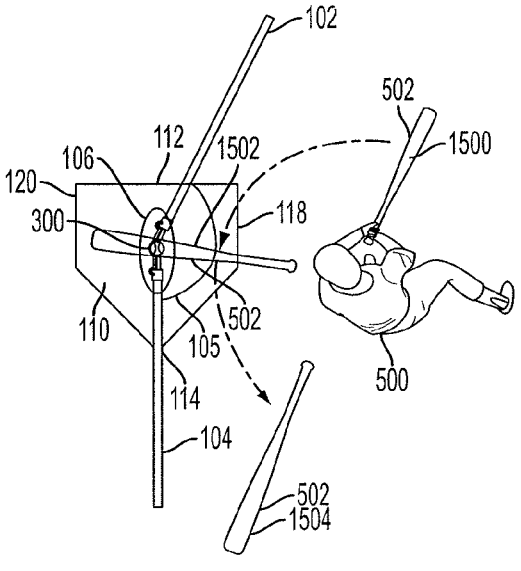
FIG. 7 is a bird's eye view illustrating a batting aid, in which a rear guide is positioned towards a batter, according to an embodiment of the present invention.

In FIG. 7, the rear guide 102 is angled slightly towards the batter 500. This removes the rear guide 102 from the plane discussed above in the discussion of FIG. 6. This different position of the rear guide 102 causes the angle 105 between the rear guide 102 and the front guide 104 to become smaller (less than 180 degrees).

As shown, the angle 105 being smaller in FIG. 7 results in more of the rear guide 102 being in the path of the bat 502 during the swing from 1500 to 1502 to 1504. Because of this, the bat 502 will be positioned above the rear guide 102 for a longer portion of the pre-POC swing. This provides the advantage of having swing guidance over a larger portion of the pre-POC swing.

If the batter 500 were swinging left handed, then the rear guide 102 should be positioned so that the angle 105 is greater than 180 degrees. This is because the batter 500 is positioned on the left side 120 of the batting aid 100 and still swing from the rear guide 102 towards the front guide 104. A larger angle 105 provides the advantage of having swing guidance over a larger portion of the pre-POC swing.

The connection 106 may be designed so that when attached to the rear guide 102 and the front guide 104, the angle 105 is 180 degrees. The connection 106 may instead be designed so that when connected to the rear guide 102 and the front guide 104, the angle 105 is less than 180 degrees. The connection 106 may also be designed so that when connected to the rear guide 102 and the front guide 104, the angle 105 is greater than 180 degrees. The connection 106 may also be adjustable so that when connected, the rear guide 102 can be adjusted. If adjustable, the connection 106 allows the rear guide to move so that the angle 105 can be set to at least one angle less than 180 degrees, and/or set to 180 degrees, and/or set to at least one angle greater than 180 degrees. The connection 106 may also be adjustable so that when connected, the front guide 104 can be adjusted in a similar fashion as the rear guide 102.

Figure 8:
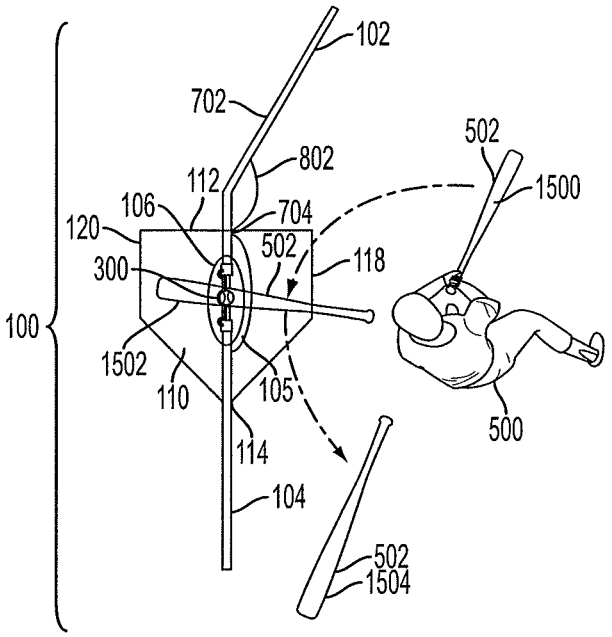
FIG. 8 is a bird's eye view illustrating a batting aid in which a portion of a rear guide is positioned towards a batter, according to an embodiment of the present invention.

In FIG. 8, the rear guide 102 has formed within it a bend. This creates a rear part 702 of the rear guide 102 and a front part 704 of the rear guide 102. The bend creates an angle 802 between the rear part 702 and the front part 704 which is less than 180 degrees.

As shown, the bend in the rear guide 102 results in more of the rear guide 102 being in the path of the bat 502 during the swing from 1500 to 1502 to 1504. Because of this, the bat 502 will be positioned above the rear guide 102 for a longer portion of the pre-POC swing. This provides the advantage of having swing guidance over a larger portion of the pre-POC swing.

If the batter 500 were swinging left handed, then the rear guide 102 should be bent so that the angle 802 is greater than 180 degrees. This is because the batter 500 is positioned on the left side 120 of the batting aid 100 and still swings from the rear guide 102 towards the front guide 104. This provides the advantage of having swing guidance over a larger portion of the pre-POC swing for a left handed batter.

Figure 9:
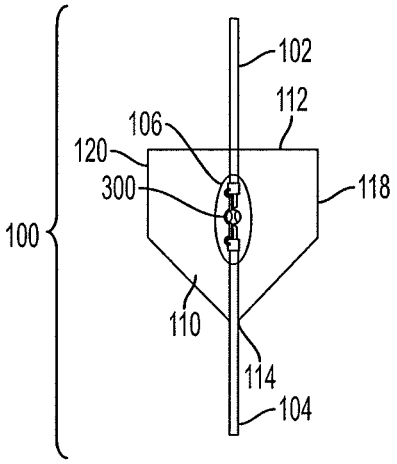
FIG. 9 is a bird's eye view illustrating a batting aid in which a rear guide and a front guide are shortened, according to an embodiment of the present invention.

In FIG. 9, the rear guide 102 and the front guide 104 are shorter in length. This allows the batting aid 100 to be better suited for children and other small batters 500. The rear guide 102 may be shorter and not the front guide 104. Additionally, the front guide 104 can be shorter and not the rear guide 102. Also, the rear guide 102 and/or the front guide 104 can be longer instead of shorter.

The shorter rear guide 102 and/or front guide 104 can be achieved in different ways. The rear guide 102 and/or the front guide 104 may be designed to be shorter. Alternately, the rear guide 102 and/or the front guide 104 can be telescoping. If this is the case, the rear guide 102 and/or the front guide 104 can be set to various lengths within a range. For example, the rear guide 102 and/or the front guide 104 may be telescoping and adjustable between the lengths of 16 inches and 32 inches. The rear guide 102 and/or the front guide 104 may be adjustable to any 2 inch increment in this range, such as 16 inches, 18 inches, 20 inches, etc. up to 32 inches. For example, the range can be different than 16 inches to 32 inches.

Figure 10:
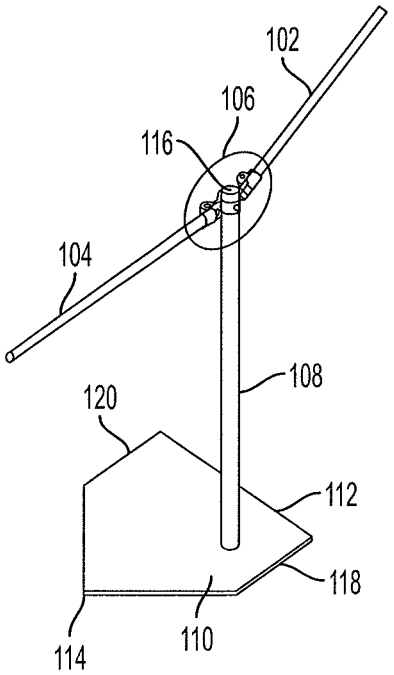
FIG. 10 is a perspective illustration of a batting aid designed for practicing swings in multiple areas in a strike zone, according to an embodiment of the present invention.

In FIG. 10, the support base 110 also represents a home base. In baseball or softball, a strike zone is defined as an area within a prism rising upwards from the home base and between the batter's knees and the midpoint between the top of the batter's shoulders and the top of his pants. Initially, the upstanding shaft 108 connects to the support base 110 at a position halfway between the left side 120 and the right side 118. In the illustrated embodiment, the upstanding shaft 108 is connected to the support base 110 at a location closer to the right side 118 than the left side.

The batting aid 100 may be designed so that the upstanding shaft 108 may be connected to the support base 110 at any of a multitude of locations on the support base 110. This allows the batter to practice swinging at balls in different regions of the strike zone.

Figure 11:
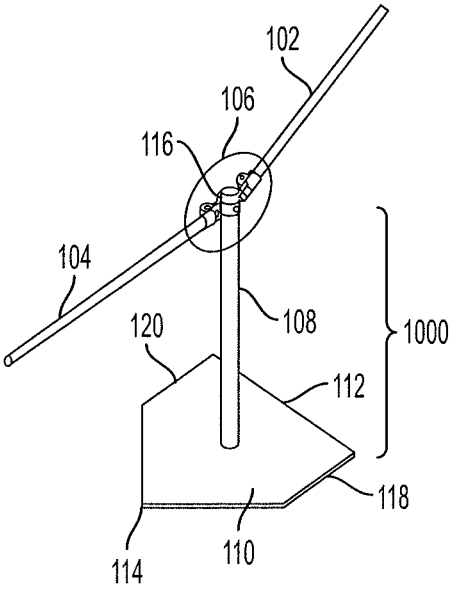
FIG. 11 is a perspective illustration of a batting aid in which height of an upstanding shaft 108 is adjustable, according to an embodiment of the present invention.

In FIG. 11, the height 1000 of the upstanding shaft 108 is shorter. The height 1000 of the upstanding shaft 108 may be adjustable and can be greater than or less than the standard height of an average tee. This feature may be provided, for example, by using a telescoping upstanding shaft 108. The height 1000 may be adjustable so that the height 1000 is between any measurements within a range. For example, the height 1000 may be between two and a half feet and 5 feet. Allowing for the height 1000 of an upstanding shaft 108 to be adjustable allows the batting aid 100 to be adjustable for batters of different heights.

A strike zone, as explained above, is positioned between the batter's knees and the midpoint between the top of the batter's shoulders and the top of his pants. Accordingly, the ability to adjust the height of the batting aid 100 allows the batting aid 100 to be positioned so that the ball 300 is located within the strike zone for the specific batter.

It is desirable for a batter to improve his swing for all regions of the strike zone. Allowing the height 1000 of a upstanding shaft 108 to be adjustable allows the batting aid 100 to be positioned for practice swinging in different regions of the strike zone, from the batter's knees to the midpoint between the top of the batter's shoulders and the top of his pants.

Figure 12:
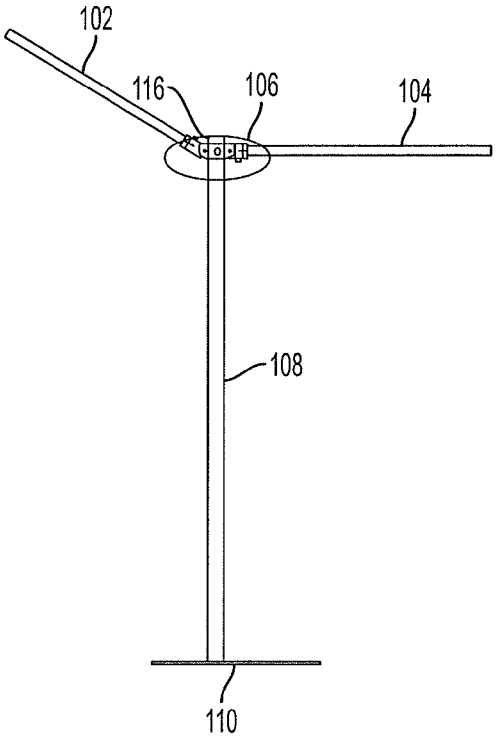
FIG. 12 is a perspective illustration of a batting aid in which a connector is detachable from the upstanding shaft, according to an embodiment of the present invention.

In FIG. 12, the connector 106 is detachable from the upstanding shaft 108. The front guide 102 and the rear guide 104 are attached to the upstanding shaft 108 via the connector 106. As illustrated, the connector 106 is also removable from the upstanding shaft 108. The connector 106 can attach to the upstanding shaft 108 in multiple ways. For example, the connector 106 may slide onto the upstanding shaft 108 or may sit on top of the upstanding shaft 108.

The connector 106 may be designed so that it stays in its intended location by friction forces between the connector 106 and the upstanding shaft 108. A fastener can be used to connect the connector 106 to the upstanding shaft 108. The connector 106 may be screwed together onto the upstanding shaft 108 or a belt can be used to attach the connector 106 to the upstanding shaft 108. The connector 106 may be positioned around the upstanding shaft 108 and a screw or screws is used to fasten the connector 106 to the upstanding shaft 108. Alternately, the connector 106 may be positioned on top of the upstanding shaft 108 and held in place in any fashion, such as a lower extension of the connector 106 which fits within the hollow 116 of the upstanding shaft 108 and holds the connector 106 in place.

Figure 13:
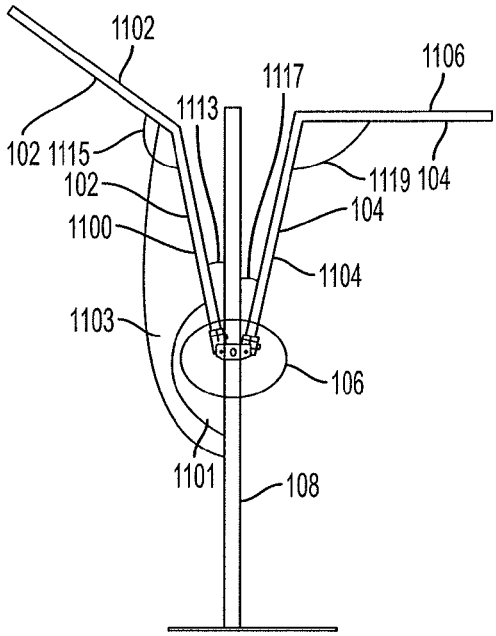
FIG. 13 is a perspective illustration of a batting aid in which a connector 106 is connected to a lower portion of an upstanding shaft, according to an embodiment of the present invention.

In FIG. 13, the connector 106 is connected to a portion of the upstanding shaft 108 that is not an upper end. The rear guide 102 and the front guide 104 each comprise two portions. The rear guide 102 includes a proximal portion 1100 and a distal portion 1102. The proximal portion 1100 is connected to the connector 106 and forms an angle 1101 from the upstanding shaft 108 which is greater than the angle 101 previously discussed. The distal portion 1102 is at a different angle 1103 from the upstanding shaft 108. The angle 1103 is the same angle as the angle 101 previously discussed.

Additionally the proximal portion 1100 of the rear guide 102 forms an angle 1113 with the tee 108. The distal portion 1102 of the rear guide 102 forms an angle 1115 with the proximal portion 1100 of the rear guide 102.

The proximal portion 1104 of the front guide 102 forms an angle 1117 with the tee 108. The distal portion 1106 of the front guide 102 forms an angle 1119 with the proximal portion 1104 of the front guide 102.

The front guide 104 includes a proximal portion 1104 and a distal portion 1106. The proximal portion is connected to the connector 106 and forms an angle T3 from the upstanding shaft 108 which is greater than the angle 103 previously discussed. The distal portion 1106 is at a different angle T4 from the upstanding shaft 108. The angle T4 is the same angle as the angle 103 previously discussed.

The connector can be placed on any portion of the upstanding shaft 108 and use any configuration of the distal guide 102 and/or proximal guide 104, such as the configuration illustrated in FIG. 2 or in FIG. 13.

Figure 14:
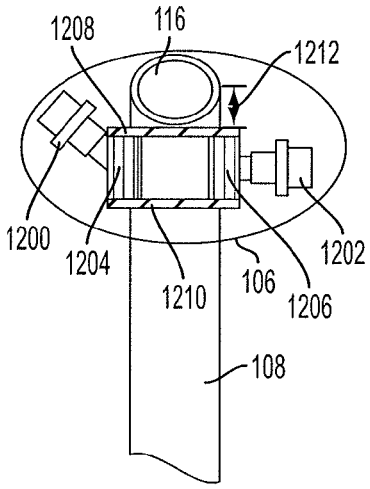
FIG. 14 is a perspective illustration of a top portion of a batting aid that uses nipples to attach a rear guide and a front guide to a connector, according to an embodiment of the present invention.

The embodiment illustrated in FIG. 14 shows nipples 1200 and 1202 located on the connector 106. The nipples 1200 and 1202 may be located on the upstanding shaft 108 and a connector 106 may not be utilized. Alternately, the nipples 1200 and 1202 may be positioned on the rear guide 104 and the front guide 104.

The connector 106 in FIG. 14 may consist of a first connector portion 1204, a second connector portion 1206, an upper connection band 1208 and a lower connection band 1210. In this embodiment, the top of the connector 106 is positioned at a distance 1212 below the hole 116. This distance 1212 may range between 0 and any distance in which the guides would still assist the batter.

The first and second connector portions 1204, 1206 and the nipples 1200, 1200 may be formed from any material, such as plastic, PVC, metal, or the like. The connection bands 1208, 1210 are designed such that they attach the first and second connector portions 1204, 1206 to the upstanding shaft 108. The connection bands 1208, 1210 may be adjustable such that they can attach the first and second connector portions 1204, 1206 to any size shaft 108. The connection bands 1208, 1210 may be formed from, for example, Velcro, rubber, plastic or the like. The connection bands 1208, 1210 are of a sufficient size that they can be used to attach the batting aid 100 to any size shaft 108.

The rear guide 102 and the front guide 104 may each have an opening in one end which allows the rear guide 102 and the front guide 104 to connect to the nipples 1200 and 1202. The opening may or may not include additional features which improve the connection between the connector 106 and/or the upstanding shaft 108 and the guides 102, 104. Using nipples 1200, 1202 may be advantageous because it provides for easier attachment of the guides 102, 104 to the upstanding shaft 108 than conventional connectors. The nipples 1200, 1202 also allow for detachability of the guides 102, 104. The nipples 1200, 1202 may be made of any material, such as metal, rubber, foam, or the like.

Figure 15:
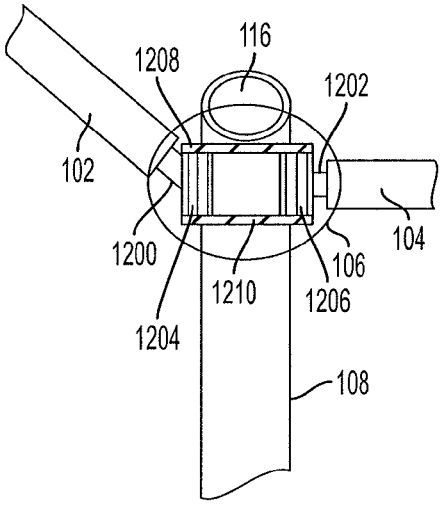
FIG. 15 is a perspective illustration of a batting aid which does not utilize a connector, according to an embodiment of the present invention.

FIG. 15 illustrates the batting aid 100 illustrated in FIG. 14 with a rear guide 102 and a front guide 104 attached. The guides 102, 104 may be formed such that a hole exists in a proximal end of each guide. The hole is designed to fit over the nipples 1200, 122 so that the hole in the rear guide 102 is filled by the first nipple 1200 and the hole in the front guide 104 is filled by the second nipple 1202. When the nipples 1200, 1202 fill the holes, a connection is established by friction between the connector 106 and the guides 102, 104.

Figure 16:
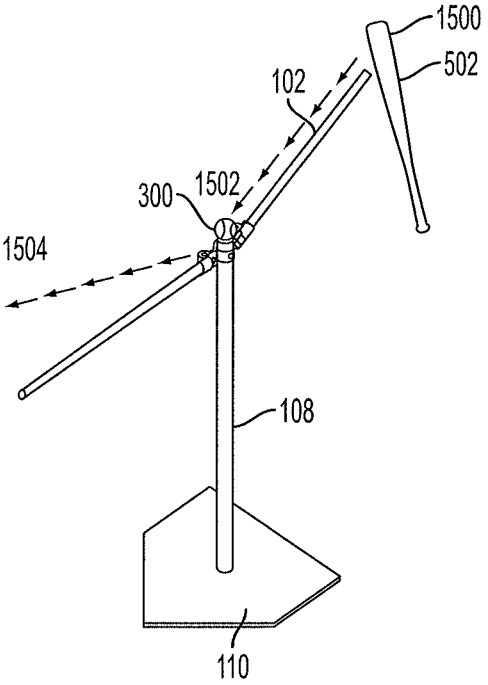
FIG. 16 is a perspective illustration of a correct swing motion utilizing an embodiment of a batting aid.

FIG. 16 illustrates a correct swing motion utilizing the batting aid 100. When a batter is practicing using the batting aid 100, the bat 502 should be held at a height above the maximum height of the rear guide 102 in position 1500. During the pre-POC swing motion (between 1500 and 1502), the bat 502 should move in a downwards motion towards the ball 300. At position 1502, the bat 502 should make contact with the ball 300. After striking the ball 300 (at 1502), the bat 502 should change trajectory and either move in a direction parallel to the ground or move in an upwards direction (the post-POC swing motion). This motion is continued between 1502 and 1504, and the swing ends at position 1504.

Figure 17:
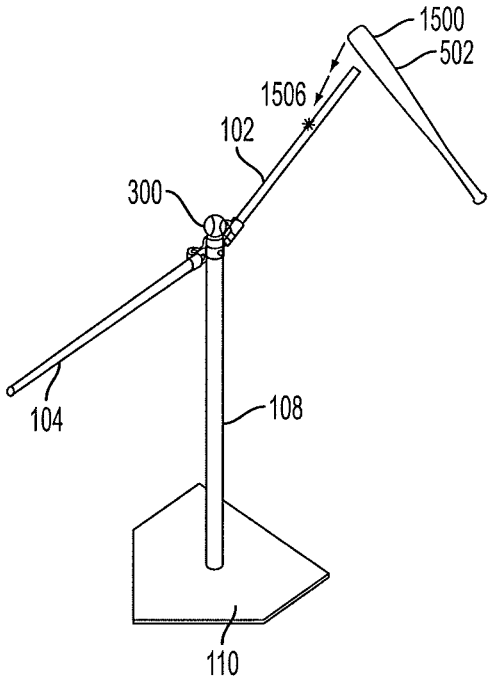
FIG. 17 is a perspective illustration of one example of an incorrect swing motion of a batter utilizing an embodiment of a batting aid.

FIG. 17 illustrates one example of an incorrect swing motion of a batter utilizing the batting aid 100. In FIG. 17, the bat 502 begins in the proper position 1500. However, the batter is using poor swing form as the trajectory of the bat 502 is too far downwards. This poor form results in a collision between the bat 502 and the rear guide 102 at position 1506. This is only one example of an incorrect swing motion. Other examples may include beginning the swing in too low of a position, not swinging in a correct downwards motion pre-POC, continuing the downwards swing post-POC, etc.

Figure 18:
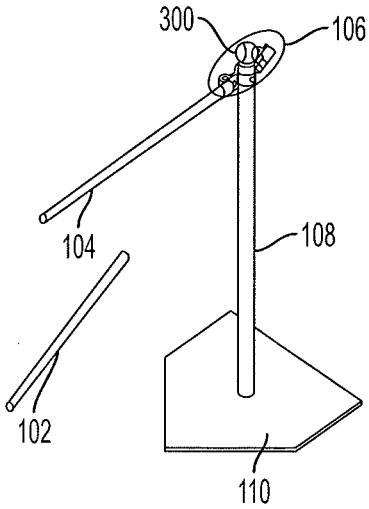
FIG. 18 is a perspective illustration of a result of a bad swing motion.

FIG. 18 illustrates the result of the bad swing motion of FIG. 17. In FIG. 18, the rear guide 102 has become disconnected from the connector 106. When the bat 502 struck the rear guide 102 in FIG. 17, the detachable rear guide 102 detached and fell harmlessly to the ground. The ball 300 may also remain on the hollow 116 as the batter hit the rear guide 102 instead of the ball 300. The front guide 104 may also become detached if the pre-POC swing was correct and the post-POC swing was not correct, such that the bat 502 struck the front guide 104. If a batter disconnects the rear guide 102 (as illustrated) or the front guide 104, then the batter should reconnect the guide 102, 104 and try again, this time altering his swing motion so that he swings correctly.

Figure 19:
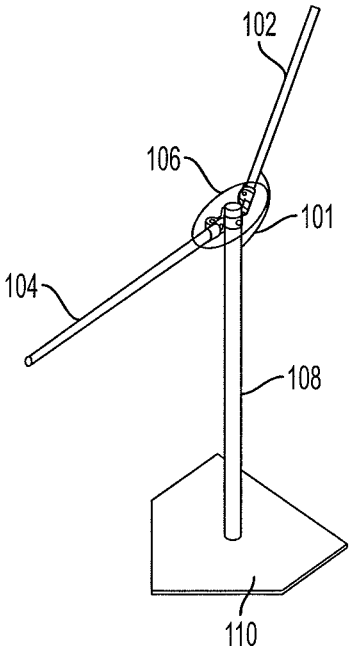
FIG. 19 is a perspective illustration of a batting aid in which a rear guide is moveable, according to an embodiment of the present invention.

FIG. 19 illustrates a batting aid 100 in which the rear guide 102 is moveable. In this embodiment, the connector (or the connection between the rear guide 102 and the upstanding shaft 108) allows the angle 101 between the rear guide 102 and the upstanding shaft 108 to change. The batting aid shown in FIG. 19 uses an angle 101 which may be, for example, 135 degrees. The rear guide 102 may be adjusted so that the angle

101 is any angle in a given range. For example, 101 may be set anywhere between 90 degrees and 135 degrees.

Figure 20:
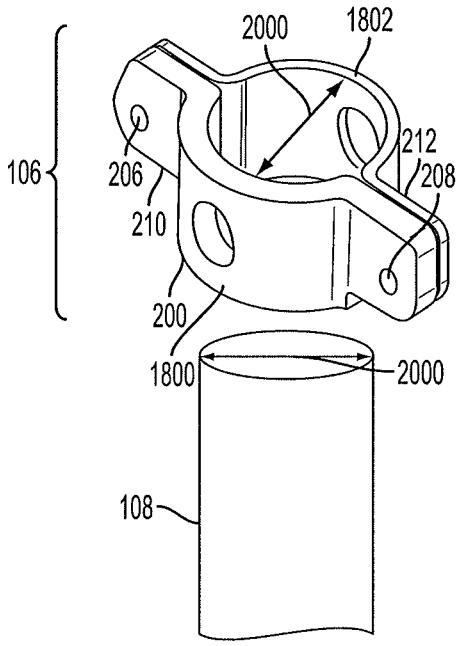
FIG. 20 is a perspective view of a connector for placement on a normal diameter upstanding shaft, according to an embodiment of the present invention.

FIG. 20 illustrates an exploded view of the connector 106 for placement on a normal diameter upstanding shaft 108. As shown, the ring 200 has an inside diameter 2000. This diameter 2000 is the same diameter as the upstanding shaft 108. Diameter 2000 may be the diameter of a normal size tee or a large size tee. This ensures that the connector 106 will fit on the illustrated upstanding shaft 108 as well as a tee having a smaller diameter than the illustrated upstanding shaft 108.

The connector 106 illustrated in FIG. 20 can also be positioned on an upstanding shaft 108 having a larger diameter. The ring 200 may include a first half 1800 and a second half 1802. A screw (not shown) may be used to connect the first half 1800 to the second half 1802 at the rear joint 206 and the front joint 208. If the diameter of the upstanding shaft 108 is larger than 2000, then the two halves 1800, 1802 may be placed around the tee so that they do not directly touch each other. They may be connected to each other by a long screw (not shown) at the rear joint 206 and one at the front joint 208. The connector 106 can then be attached to a tee having a much larger diameter if the screw was long enough to reach both of the halves 1800, 1802 at the two joints 206, 208.

Figure 21:
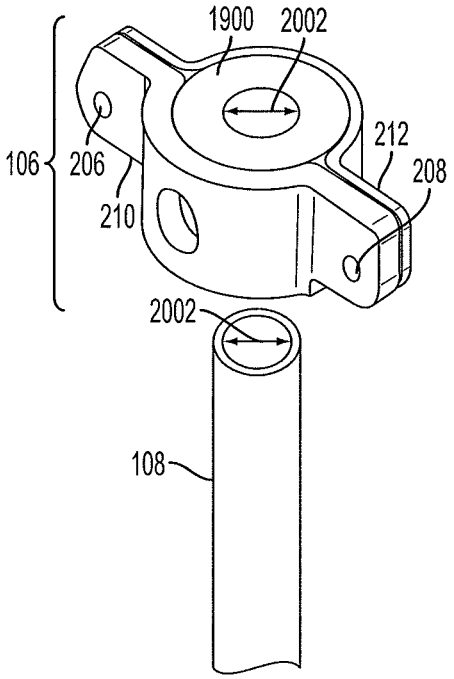
FIG. 21 is a perspective view of a connector having a smaller diameter, according to an embodiment of the present invention.

FIG. 21 illustrates how the connector 106 can be positioned on an upstanding shaft 108 having a smaller diameter. The connector 106 of FIG. 21 is the same as the connector 106 of FIG. 20. However, the upstanding shaft 108 in FIG. 21 has a smaller diameter than the upstanding shaft 108 illustrated in FIG. 20. A stopper 1900 having a hole of diameter 2002 is provided to accommodate the smaller diameter 2002 of the upstanding shaft 108. The stopper 1900 may be made from, for example, rubber, metal, foam, or a material having similar characteristics. The stopper 1900 may be positioned within the ring 200 so that friction forces cause the stopper 1900 to be connected to the connector 106 as well as the upstanding shaft 108.

What is claimed is:

1. A batting aid for teaching proper swing motion of a bat, comprising:

an upstanding tee having an axial length and an upper end and a lower end, the lower end at ground level, the upper end having a hollow for receiving a ball;

a connector attached to the tee having a first connection and a second connection, the second connection rotated at an angle from the first connection;

a rear guide having a distal end and a proximal end, the rear guide connected to the first connection of the connector at the proximal end and configured to detach from the first connection such that the rear guide detaches from the first connection when struck by a batter, the distal end of the rear guide positioned at a height above the hollow in the upstanding tee for guiding a bat to the ball on the tee in a downward path; and a front guide having a distal end and a proximal end, the front guide connected to the second connection of the connector at the proximal end and configured to detach from the second connection such that the front guide detaches from the second connection when struck by the batter, the front guide positioned at a height slightly below or above the hollow in the upstanding tee for guiding a bat after the ball on the tee is struck, whereby the batter swings a bat towards the ball on the tee along the rear guide, strikes the ball with the bat, and moves the bat along the front guide, after striking the ball.

2. The batting aid of claim 1 wherein the rear and front guides are formed from straight rods of metal, plastic, rubber or foam.

3. The batting aid of claim 1 wherein each of the rear guide and the front guide are approximately 24 inches in length.

4. The batting aid of claim 1 wherein the first connection and the second connection are each brackets.

5. The batting aid of claim 1 wherein the first connection and the second connection are each nipple connectors.

6. The batting aid of claim 1 wherein the angle between the horizontal plane of the rear guide and the tee axis is between 110 degrees and 135 degrees and the angle between the horizontal plane of the from guide and the tee axis is approximately 90 degrees.

7. The batting aid of claim 1 wherein the connector includes two portions such that the two portions can be connected to different sides of the tee by a pair of bands encircling the tee and the two portions.

8. The batting aid of claim 1 further comprising a rubber insert adapted to fit within the connector that enables the connector to connect to a tee having a smaller diameter than a diameter of the connector.

9. A batting aid for use with an upstanding tee having an axial length and an upper end and a lower end, the upper end having a hollow for receiving a ball, the batting aid comprising:

a connector attachable to the tee, the connector having a first connection and a second connection, the second connection rotated at an angle from the first connection;

a rear guide having a distal end and a proximal end, the rear guide connected to the first connection of the connector at the proximal end and configured to detach from the first connection such that the rear guide detaches from the first connection when struck by a batter, the distal end of the rear guide positioned at a height above the hollow in the upstanding tee for guiding a bat to the ball on the tee in a downward path; and a front guide having a distal end and a proximal end, the front guide connected to the second connection of the connector at the proximal end and configured to detach from the second connection such that the front guide detaches from the second connection when struck by the batter, the distal end of the front guide positioned at a height slightly below or above the hollow in the upstanding tee for guiding a bat after the ball on the tee is struck, whereby a batter swings a bat towards the ball on the tee along the rear guide, strikes the ball with the bat, and moves the bat along the front guide, after striking the ball.

10. The batting aid of claim 9 wherein the rear and front guides are formed from straight rods of metal, plastic, rubber or foam.

11. The batting aid of claim 9 wherein each of the rear guide and the front guide are approximately 24 inches in length.

12. The batting aid of claim 9 wherein the first connection and the second connection are each brackets.

13. The batting aid of claim 9 wherein the first connection and the second connection are each nipple connectors.

14. The batting aid of claim 9 wherein the angle between the horizontal plane of the rear guide and the tee axis is between 110 degrees and 135 degrees and the angle between the horizontal plane of the front guide and the tee axis is approximately 90 degrees.

15. The batting aid of claim 9 wherein the connector includes two portions such that the two portions can be connected to different sides of the tee by a pair of bands encircling the tee and the two portions.

16. The batting aid of claim 9 further comprising a rubber insert adapted to fit within the ring of the connector such that the connector can attach to a tee having a smaller diameter than a diameter of the ring.

17. A batting aid for use with a tee having an axial length and an upper end and a lower end, the upper end having a hollow for receiving a ball, the batting aid comprising:

a connector attachable to the tee along an axial length of the tee, the connector having a first connection and a second connection, the second connection rotated by an angle from the first connection;

a rear guide with a first portion having an axial length, a distal end and a proximal end connected to the first connection at the proximal end at an acute angle to the axial length of the tee, and a second portion having an axial length, a distal end and a proximal end, attached to the distal end of the first portion at the proximal end at an obtuse angle to the axial length of the first portion of the first guide, the distal end of the second portion being at a height above the hollow in the tee for guiding a bat to the ball on the tee in a downward path, and the rear guide being configured to detach from the first connection when struck by a batter; and a front guide with a first portion having an axial length, a distal end and a proximal end connected to the second connection at the proximal end at an acute angle to the axial length of the tee, and a second portion having an axial length, a distal end and a proximal end attached to the distal end of the first portion at the proximal end at an obtuse angle to the axial length of the first portion of the second guide, at a height slightly below or above the hollow in the tee for guiding a bat after the ball on the tee is struck, the front guide being configured to detach from the second connection when struck by a batter, whereby a batter swings a bat towards the ball on the tee along the rear portion of the rear guide, strikes the ball with the bat, and moves the bat along the front portion of the second guide after striking the ball.

18. The batting aid of claim 17 wherein the first connection and the second connection are each brackets.

19. The batting aid of claim 17 wherein the first connection and the second connection are each nipple connectors.

20. The batting aid of claim 17 wherein an angle between a line extending towards the tee from the second portion of the rear guide and the tee is between 110 degrees and 135 degrees and an angle between a line extending towards the tee from the second portion of the second front guide and the tee is approximately 90 degrees.

* * * * *